US008287348B2

(12) United States Patent
Bramble

(10) Patent No.: US 8,287,348 B2
(45) Date of Patent: Oct. 16, 2012

(54) GAMING SYSTEM FOR A POKER-STYLE GAME

(75) Inventor: Paul Francis Jason Bramble, Leumeah (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 603 days.

(21) Appl. No.: 12/415,837

(22) Filed: Mar. 31, 2009

(65) Prior Publication Data

US 2009/0247252 A1 Oct. 1, 2009

(30) Foreign Application Priority Data

Mar. 31, 2008 (AU) ..... 2008901551

(51) Int. Cl.
*A63F 9/24* (2006.01)

(52) U.S. Cl. ..... 463/13

(58) Field of Classification Search ..... 463/13, 463/26

See application file for complete search history.

(56) References Cited

U.S. PATENT DOCUMENTS

| | | | | |
|---|---|---|---|---|
| 5,486,005 | A | 1/1996 | Neal | |
| 6,173,955 | B1 | 1/2001 | Perrie et al. | |
| 6,273,424 | B1 | 8/2001 | Breeding | |
| 2004/0195770 | A1 | 10/2004 | Ornstein | |
| 2006/0063578 | A1 * | 3/2006 | Bansemer et al. | 463/13 |
| 2007/0057466 | A1 * | 3/2007 | Soltys et al. | 273/292 |
| 2007/0063012 | A1 | 3/2007 | Hollins et al. | |
| 2007/0063031 | A1 | 3/2007 | Silverbrook et al. | |
| 2007/0063032 | A1 | 3/2007 | Silverbrook et al. | |
| 2007/0063033 | A1 | 3/2007 | Silverbrook et al. | |
| 2007/0063034 | A1 | 3/2007 | Silverbrook et al. | |
| 2007/0063035 | A1 | 3/2007 | Silverbrook et al. | |
| 2007/0063036 | A1 | 3/2007 | Silverbrook et al. | |
| 2007/0063037 | A1 | 3/2007 | Silverbrook et al. | |
| 2007/0063038 | A1 | 3/2007 | Silverbrook et al. | |
| 2007/0063039 | A1 | 3/2007 | Silverbrook et al. | |
| 2007/0069462 | A1 | 3/2007 | Downs et al. | |
| 2007/0070372 | A1 | 3/2007 | Lapstun et al. | |
| 2007/0070390 | A1 | 3/2007 | Silverbrook et al. | |
| 2007/0070391 | A1 | 3/2007 | Lapstun et al. | |
| 2007/0072663 | A1 | 3/2007 | Kuhn et al. | |
| 2007/0072664 | A1 | 3/2007 | Kuhn et al. | |
| 2007/0077976 | A1 | 4/2007 | Jackson | |
| 2007/0082737 | A1 | 4/2007 | Morrow et al. | |
| 2007/0084916 | A1 | 4/2007 | Silverbrook et al. | |
| 2007/0085332 | A1 | 4/2007 | Lapstun et al. | |
| 2007/0087804 | A1 | 4/2007 | Knowles et al. | |
| 2007/0093283 | A1 | 4/2007 | Ogilvie | |
| 2007/0093284 | A1 | 4/2007 | Ogilvie | |

(Continued)

FOREIGN PATENT DOCUMENTS

| | | |
|---|---|---|
| EP | 1473681 | 11/2004 |

(Continued)

*Primary Examiner* — Brook Kebede

(74) *Attorney, Agent, or Firm* — Hanley, Flight & Zimmerman, LLC

(57) ABSTRACT

A gaming method for providing a poker-style game on a gaming device includes selecting at least one player card to form at least part of a player hand, selecting at least one machine card to form at least part of a machine hand. A prize schedule payable to the player if the player were to win a completed hand is calculated based on the selected cards. The player decides whether to continue play of the game utilizing their hand, after being provided with the calculated prize schedule.

20 Claims, 6 Drawing Sheets

U.S. PATENT DOCUMENTS

| | | | |
|---|---|---|---|
| 2007/0093297 | A1 | 4/2007 | Moshal |
| 2007/0102879 | A1 | 5/2007 | Stasson |
| 2007/0111776 | A1 | 5/2007 | Griswold et al. |
| 2007/0117608 | A1 | 5/2007 | Roper et al. |
| 2007/0117623 | A1 | 5/2007 | Nelson et al. |
| 2007/0135193 | A1 | 6/2007 | Nicely |
| 2007/0135194 | A1 | 6/2007 | Nicely et al. |
| 2007/0135207 | A1 | 6/2007 | Tarantino |
| 2007/0142107 | A1 | 6/2007 | Kuhn et al. |
| 2007/0142108 | A1 | 6/2007 | Linard et al. |
| 2007/0149292 | A1 | 6/2007 | Kaminkow et al. |
| 2007/0155462 | A1 | 7/2007 | O'Halloran et al. |
| 2007/0155464 | A1 | 7/2007 | Baerlocher et al. |
| 2007/0155466 | A1 | 7/2007 | Baerlocher et al. |
| 2007/0167210 | A1 | 7/2007 | Kelly et al. |
| 2007/0167226 | A1 | 7/2007 | Kelly et al. |
| 2007/0184905 | A1 | 8/2007 | Gatto et al. |
| 2007/0191084 | A1 | 8/2007 | Tarantino |
| 2007/0191109 | A1 | 8/2007 | Crowder et al. |

FOREIGN PATENT DOCUMENTS

| | | |
|---|---|---|
| GB | 376759 | 7/1932 |
| GB | 986124 | 3/1965 |
| WO | 02098525 | 12/2002 |

* cited by examiner

GAMING SYSTEM FOR A POKER-STYLE GAME

CROSS-REFERENCE TO RELATED APPLICATIONS

The present application claims the benefit of priority to Australian Provisional Patent Application No. 2008901551, filed on Mar. 31, 2008, entitled "A GAMING SYSTEM FOR A POKER-STYLE GAME", which is herein incorporated by reference in its entirety.

FIELD OF THE INVENTION

The present invention relates to a gaming system and a method of gaming, and particularly, but not exclusively, to a gaming system and method of providing a poker-style game.

BACKGROUND OF THE INVENTION

Poker is a type of card game in which at least two players bet on the value of the card combination ("hand") in their possession. The winner of the hand is the player who holds the hand with the highest value according to an established hand rankings hierarchy. In some forms of poker, the player is given an opportunity to "fold" (i.e. withdraw from a particular hand). Poker combines elements of chance and elements of skill, making it a very popular and attractive game to many players.

Poker has many variations, all following a similar pattern of play. Depending on the variant, hands may be formed using cards, which are concealed from others, or from a combination of concealed cards and open cards (i.e. cards that all players can see). Some variations are called Texas Hold'em, Draw Poker, 7 card stud poker and Omaha. Details of different types of poker games may be found at, for example, the publicly available website http://en.wikipedia.org/wiki/Poker. Each game has slightly different rules, but they all retain the same basic elements (i.e. the player who holds the hand with the highest value according to an established hand rankings hierarchy wins the hand).

Other games that use poker hand rankings may likewise be referred to as poker or a "poker-style game". For example, video poker is a single-player computer game that functions much like a reel-based gaming machine. While such gaming systems provide users with enjoyment, the need exists for alternative gaming systems in order to maintain or increase player enjoyment.

SUMMARY OF THE INVENTION

In accordance with a first aspect, the present invention provides a gaming method for providing a poker-style game on a gaming device, including, selecting at least one player card to form at least part of a player hand, selecting at least one machine card to form at least part of a machine hand, calculating a prize schedule payable to the player if the player were to win a completed hand based on the selected cards, and providing the prize schedule to the player, wherein the player decides whether to continue with the hand based on the calculated prize schedule.

The player may select the at least one player card, and in one embodiment, selects two player cards. The player may select the at least one machine card, and in one embodiment, the player selects two machine cards.

In one embodiment, the at least one of the player cards and machine cards are selected from a standard deck of 52 playing cards. Alternatively, the at least one of the player cards and machine cards are chosen from a sub-set of standard playing cards, the sub-set being pre-selected by the gaming device.

In one embodiment, the prize schedule calculation is based on the probability of the player winning the hand.

In one embodiment, the gaming machine may allow a plurality of players, wherein at least one player card is selected for each player, and a prize schedule is calculated for each of the plurality of players.

If the player selects to continue with the hand, further cards may be dealt in a randomised manner, until the hand is completed. In one embodiment, on each further card being dealt, re-calculating the prize schedule, and allowing the player to decide whether to continue with the hand based on the re-calculated prize schedule.

In accordance with a second aspect, the present invention provides a gaming device operable to carry out play of a poker-style game, the gaming device including a game control module arranged to select at least one player card and at least one machine card from at least one deck of cards, a prize schedule module arranged to calculate a prize schedule payable to the player if the player were to win a completed hand based on the selected cards, a display module arranged to provide the prize schedule to the player, and an interface arranged to allow the player to determine whether to continue with the hand, based on the calculated prize schedule.

In an embodiment the gaming device the interface is further operable to allow the player to instruct selection of either or both the player card and machine card.

In an embodiment the game control module allows the player to select two player and/or machine cards.

In an embodiment at least one of the player cards and machine cards are selected from a standard deck of 52 playing cards.

In an embodiment at least one of the player cards and machine cards are chosen from a sub-set of standard playing cards pre-selected by the gaming device.

In an embodiment the calculation made by the prize schedule module is based on the probability of the player winning the hand.

In an embodiment, where a plurality of players are participating in the poker-style game, the device is arranged to select at least one player card for each player and display a prize schedule payable to each of the plurality of players based on their respective hands.

In an embodiment, if the player selects to continue with the hand, further cards are dealt by the game control module in a randomised manner, until the hand is completed.

In an embodiment, on each further card being dealt, the prize calculation module re-calculates the prize schedule and displays it to the player(s), the players allowed to determine whether to continue with the hand based on the re-calculated prize schedule.

In accordance with a third aspect, the present invention provides a gaming system including: a plurality of gaming devices which may participate in a poker-style game; and a game control module arranged to allow the selection of at least one player card and at least one machine card from at least one deck of cards, a prize schedule determination module arranged to calculate a prize schedule payable to the player if the player were to win a completed hand based on the current card selection, a display module arranged to display the prize schedule to the player, and an interface arranged to allow the player to decide whether to continue with the hand based on the calculated prize schedule.

In accordance with a fourth aspect, the present invention provides a computer program code which when executed implements the method of the first aspect.

In accordance with a fifth aspect, the present invention provides a computer readable medium including the program code of the fourth aspect.

In accordance with a sixth aspect, the invention provides a data signal including the program code of the fourth aspect.

BRIEF DESCRIPTION OF THE DRAWINGS

Features and advantages of the present invention will become apparent from the following description of embodiments thereof, by way of example only, with reference to the accompanying drawings, in which.

Features, further aspects, and advantages of the present invention will become apparent from the following description of embodiments thereof, by way of example only, with reference to the accompanying drawings. Also, various embodiments of the aspects described in the preceding paragraphs will be apparent from the appended claims, the following description and/or the accompanying drawings. It should be understood, however, that the present invention is not limited to the arrangements and instrumentality shown in the attached drawings.

DETAILED DESCRIPTION OF AN EMBODIMENT

The embodiment described herein provides a gaming method for providing a poker-style game on a gaming machine. On selection of at least one player card to form at least part of a player hand, and selection of at least one machine card to form at least part of a machine hand, a prize schedule payable to the player (if the player were to win the hand) is calculated based on the current card selections. The prize schedule is provided to the player, wherein the player can decide whether to continue with the hand based on the calculated prize schedule.

The gaming system (which implements a method in accordance with the embodiment) may be provided in a number of different forms.

In a first form, a stand alone gaming machine is provided wherein all or most components implementing the game are present in a player operable gaming machine.

In a second form, a distributed architecture is provided wherein some of the components implementing the game are present in a player operable gaming machine and some of the components implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 1:
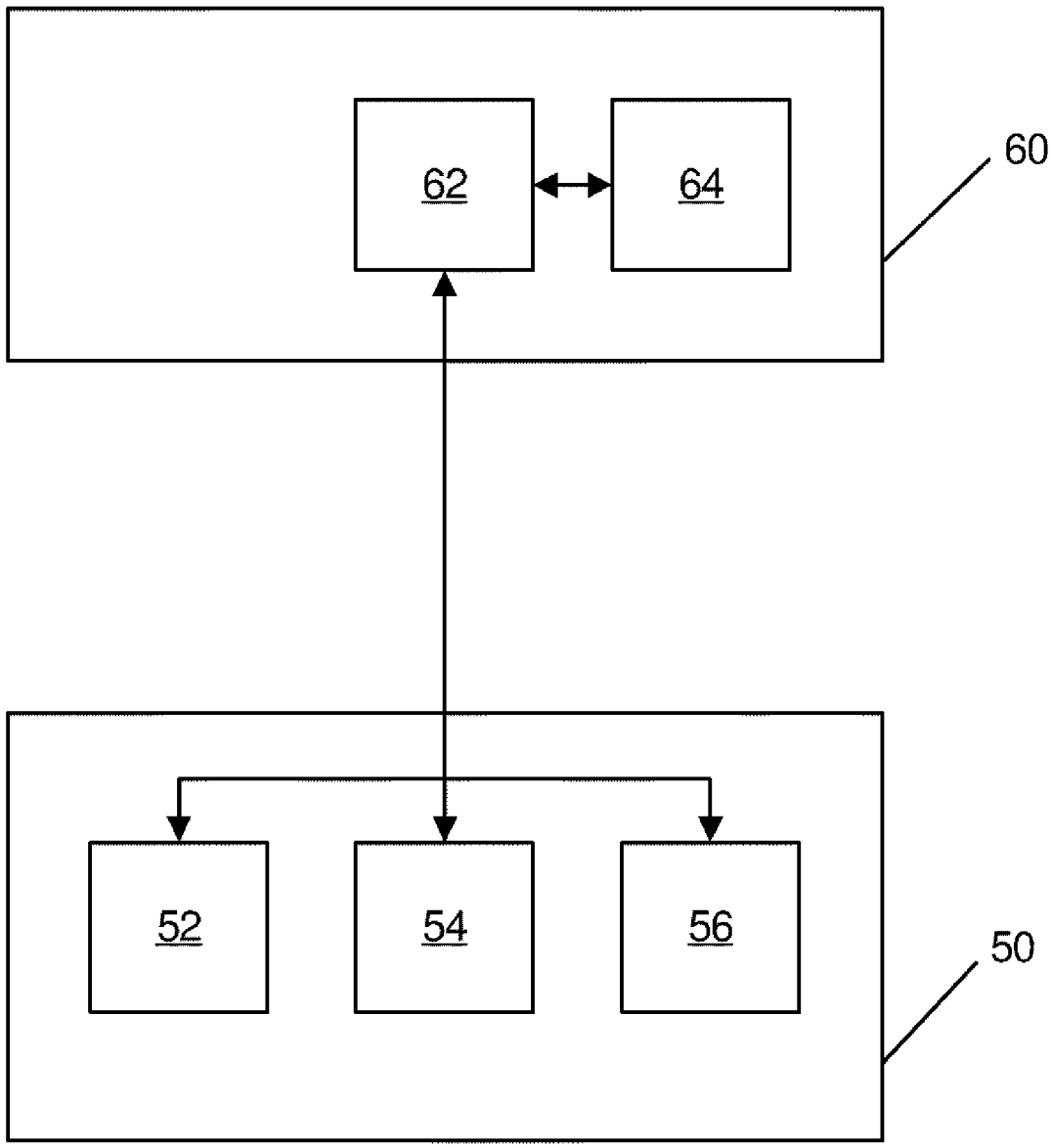
FIG. 1 is a schematic block diagram of core components of a gaming system in accordance with an embodiment of the present invention.

Irrespective of the form, the gaming system includes several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions and play the game.

Components of the player interface may vary from embodiment to embodiment but will typically include a credit mechanism 52 to enable a player to input credits and receive payouts, one or more displays 54 and a game play mechanism 56 that enables a player to input game play instructions.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
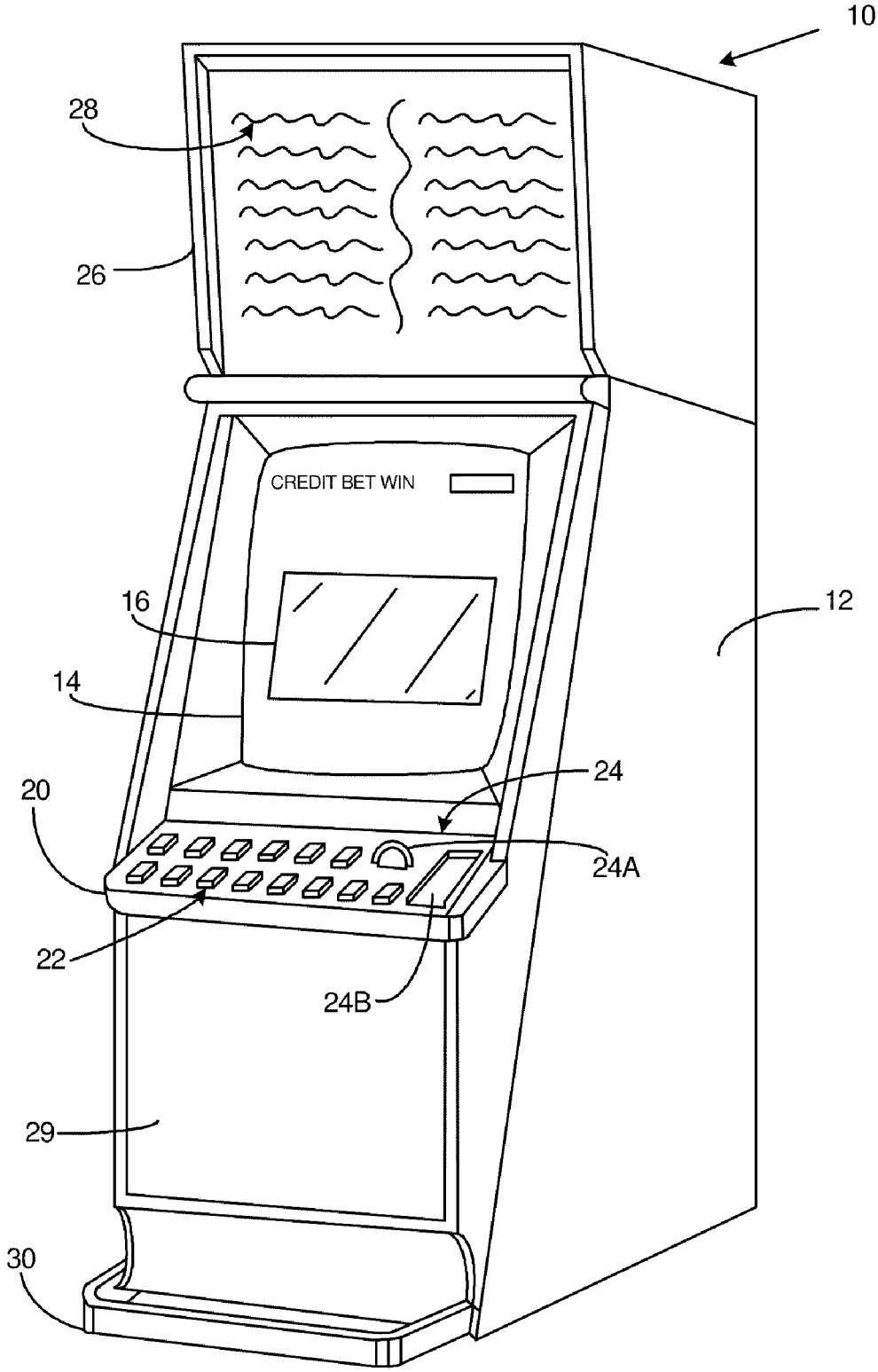
FIG. 2 is a diagrammatic representation of a gaming system in accordance with an embodiment of the present invention with the gaming system implemented in the form of a stand alone gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module may be provided having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12.

A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
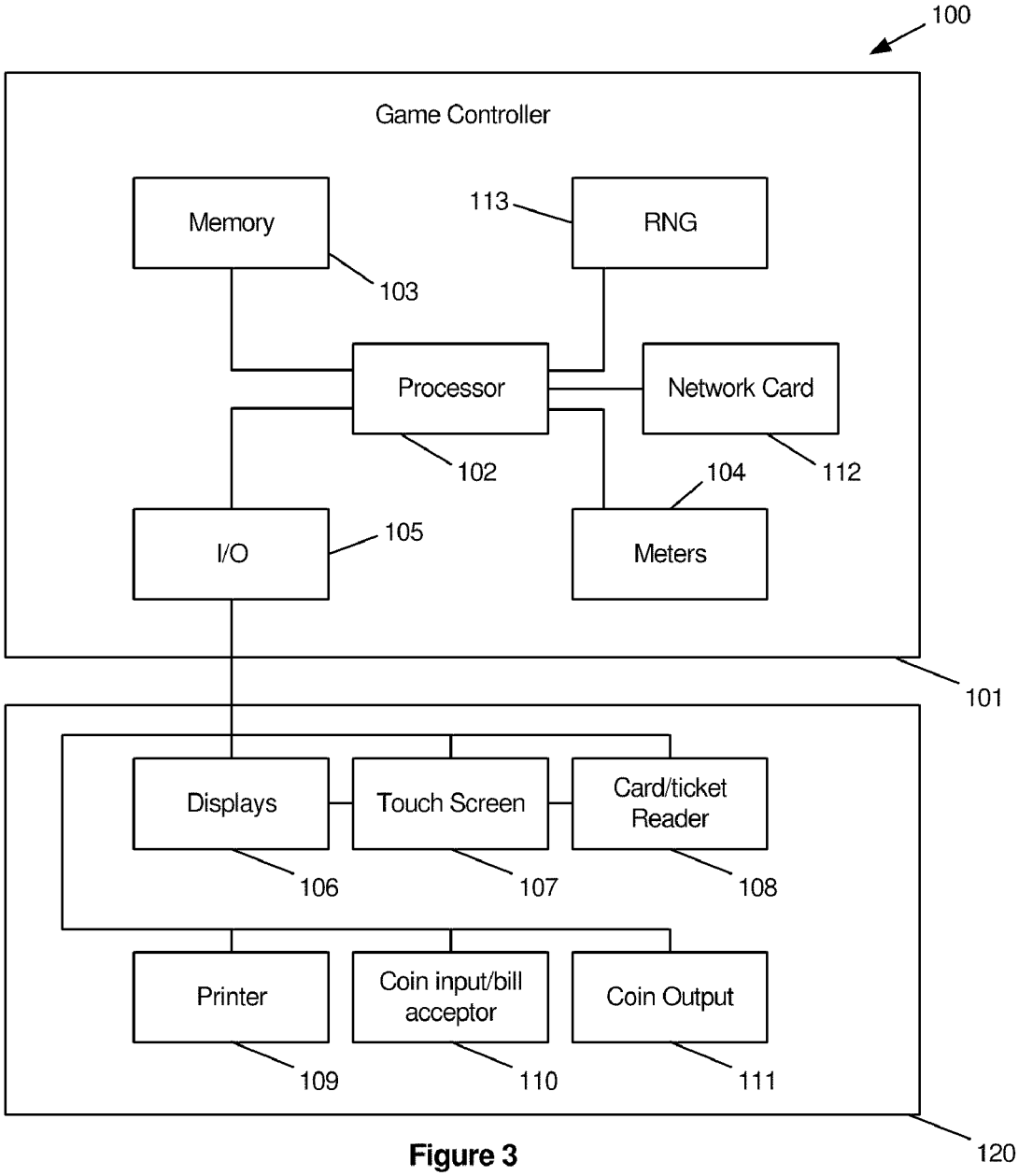
FIG. 3 is a schematic block diagram of operative components of the gaming machine shown in FIG. 2.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 include one or more displays 106, a touch screen 107, a card and/or ticket reader 108, a printer 109, a bill acceptor and/or coin input mechanism 110 and a coin output mechanism 111. Additional hardware may be included as part of the gaming machine 100, or hardware may be based on the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
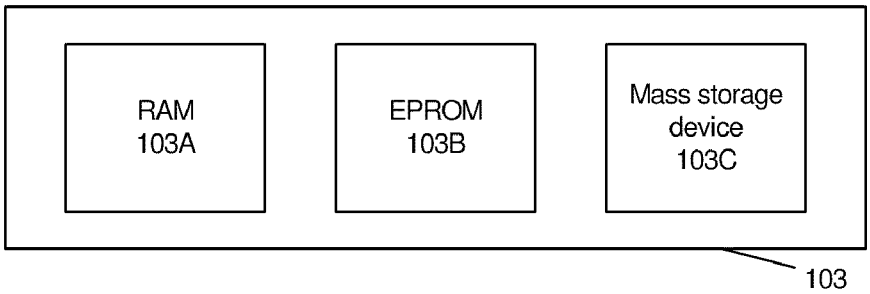
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
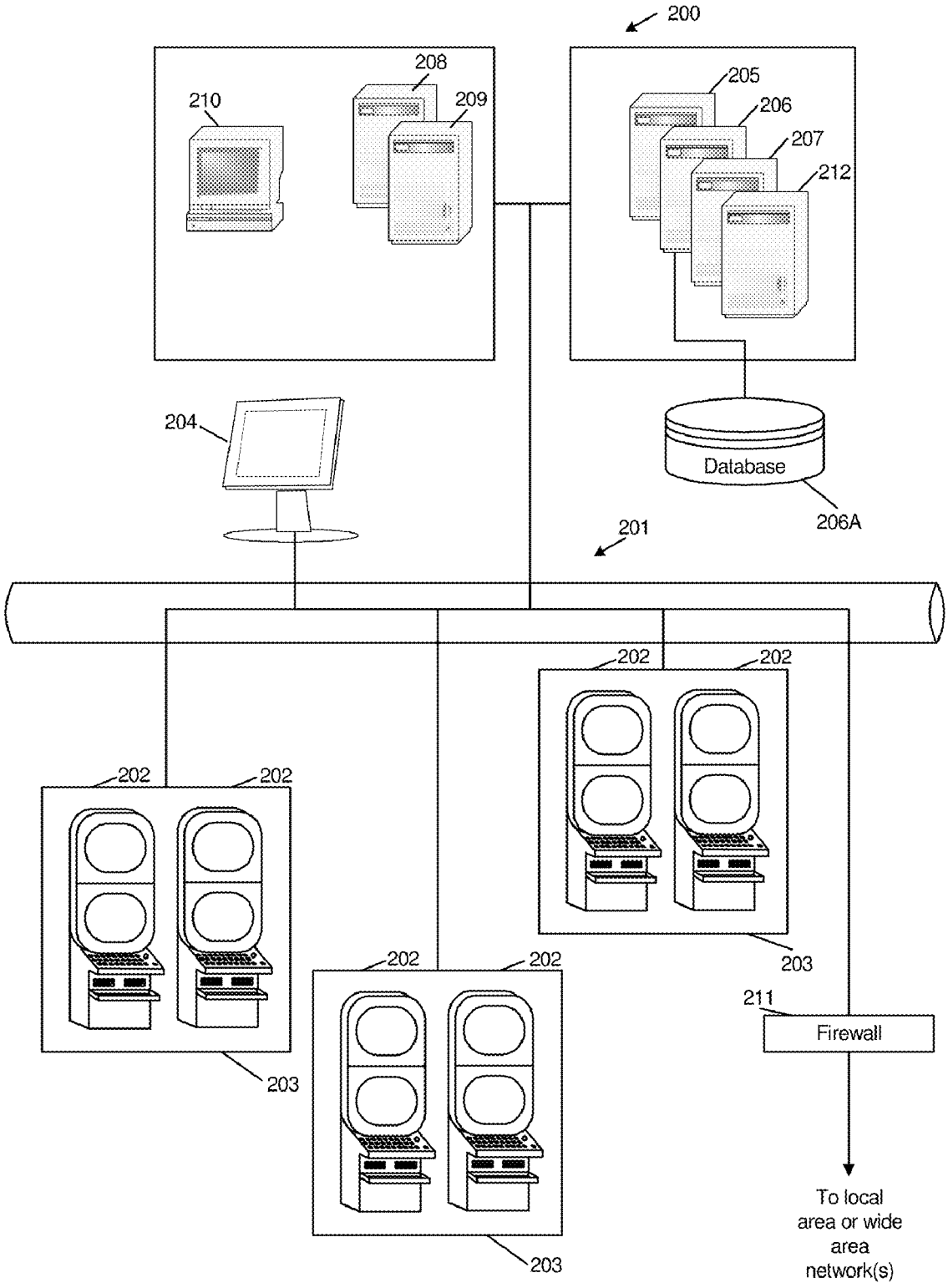
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the rules and/or guidelines for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to carry out the accounting in respect of the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games based on the terminals.

In yet a further alternative embodiment (not shown), one of the individual gaming machines 202 is a capable of acting as the server, providing networked game play and awarding functionality for the other gaming machines 202. In such an embodiment, the gaming machines not acting as the server would be designated as slaves (i.e. the clients).

Exemplary embodiments of the present invention relate to gaming systems that implement a poker-style game (i.e. any one of a variety of different poker games). In one embodiment, the display 54 initially shows five cards presented face down and the cards are turned over to reveal the faces. The cards can be shown as being dealt face down. In other embodiments (for example, in single player games), the cards are shown as being dealt face up.

Figure 6:
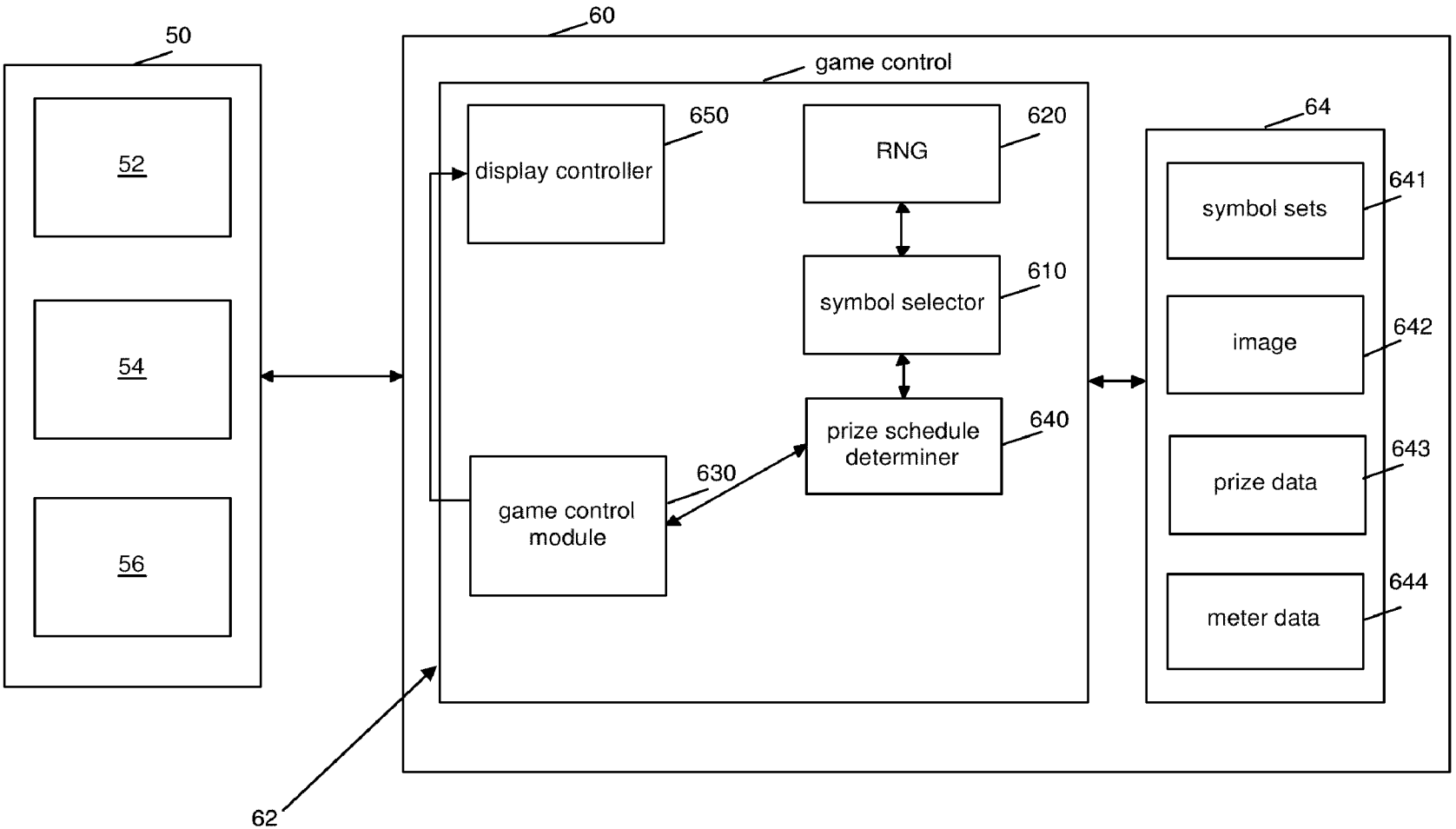
FIG. 6 is a schematic diagram of functional components of a gaming system in accordance with an embodiment of the present invention.

The game controller of one embodiment is shown in more detail in FIG. 6. The game controller 60 incorporates a processor 62 which implements a symbol selector 610, random number generator 620, game control module 630, and prize schedule determiner 640 based on program code stored in memory 64. Memory 64 includes, symbol sets 641, image data 642, prize data 643 and meter data 644. There is also provided a display controller 650, which interfaces with the display 54. Persons skilled in the art will appreciate that one or more of these components could be provided in other ways, for example by way of a dedicated circuit.

In an example of a game to which the invention is applied, symbol selector 610 selects symbols from symbol set 641 to display in the display positions on the display 54. In the embodiment, the game is a poker-style game wherein the display positions are occupied by a set of virtual "cards", with a set being displayed for each player, and a set being displayed for the gaming machine (the gaming machine functioning as a "virtual" player). As will be described in more detail later, some symbols (cards) may be selected by the user utilizing the interface 50, and some symbols may be automatically selected by the machine, using either predetermined values held in memory 64, or randomly, with the aid of the random number generator 620.

The embodiment described herein seeks to provide the player with a variety of different manners in which to play a poker-style game. The player may choose certain cards to be dealt and may choose certain cards to play against. Typically the player must stake a wager according to the cards they choose to play with and against. A prize is awarded if the player's cards win the hand against their opponent hands. A consolation prize returning the wager may also be awarded in case of a tie, though the wager may alternatively be put towards the next hand.

Figure 7:
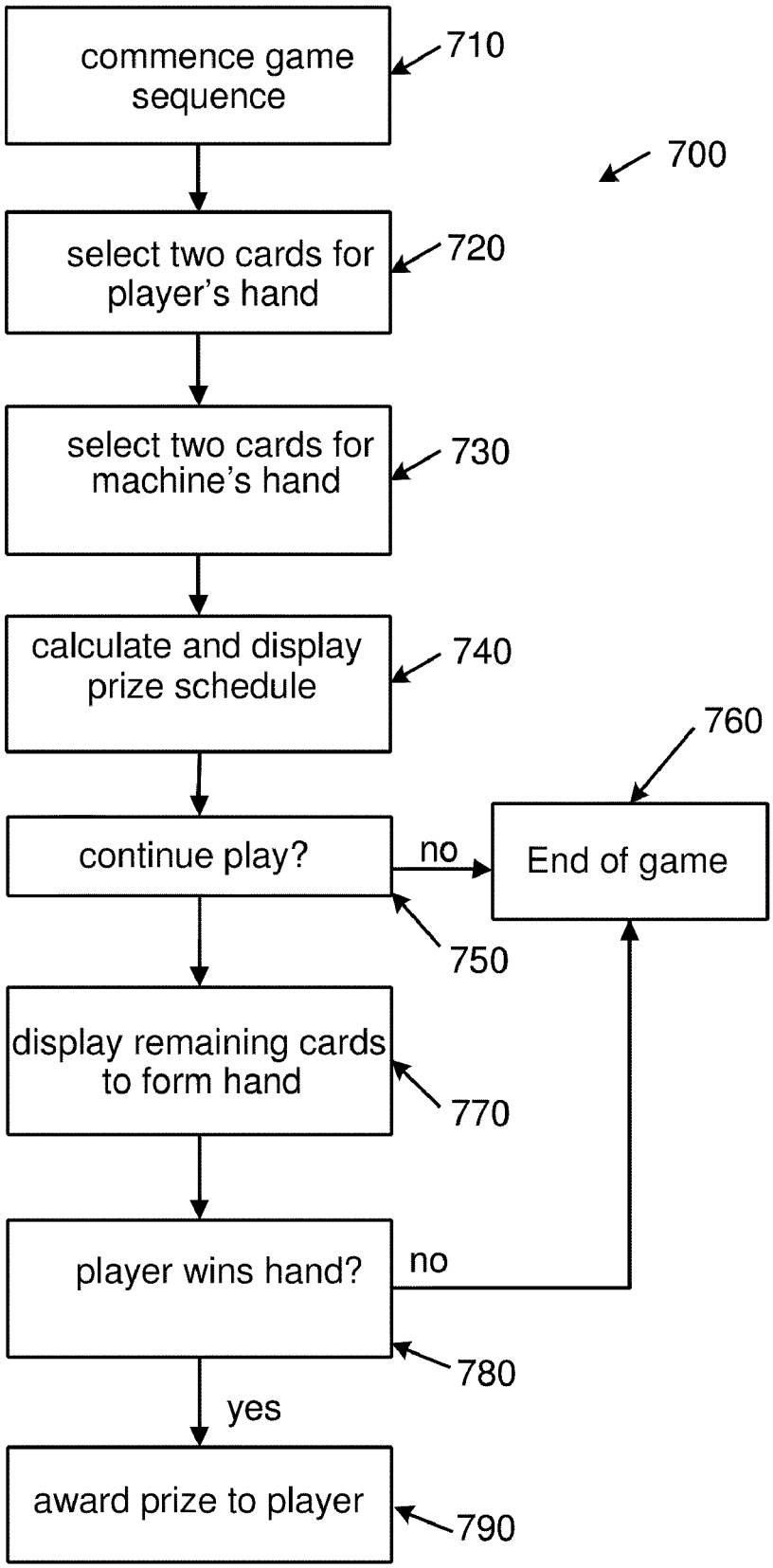
FIG. 7 is a flow diagram illustrating operation of a gaming system in accordance with an embodiment of the present invention.

An embodiment of the game operates in accordance with the flow chart 700 provided at FIG. 7. At step 710, a player wishes to commence a game sequence. The player selects at least one card (although in the presently described embodiment, two cards are selected), which will form part of the player's hand (step 720). The player then selects at least one other card, which will form at least part of the gaming machine's hand (step 730). Based on the cards selected by the player, the gaming machine calculates a prize schedule and displays the schedule to the player (step 740). The player may then choose whether to continue game play based on the calculated prize schedule (step 750). If the player does not wish to continue, the game ends (step 760). If the player elects to continue game play (e.g. by issuing an instruction utilising the interface 50), further cards are dealt until the hand is completed (770). A determination is made as to whether the player has won the hand (step 780). If not, the game ends (step 760). If the player wins, a prize is paid out to the player in accordance with the prize schedule (step 790).

In more detail, a player, once placing credit in a gaming machine in accordance with an embodiment of the invention, is presented with a user interface that allows the player to select two cards out of a given amount of cards.

The choices available for the player could be:

a) any two cards out of a deck of 52 cards (in a deck without a joker), or b) defined "pairs" of cards, pre-chosen by the machine; e.g. a pair of Aces, a pairs of Kings, a Queen and a 7 (seven) of Clubs, etc.

The two cards chosen by the player are designated as "player's cards" (i.e. they are used to make up the player's hand in the poker-style game). Once the player has selected their two cards, the player may then select two cards which become the "machine's cards" (i.e. they are used to make up the machine's hand in the poker-style game). In another embodiment, the gaming machine may randomly (e.g. with the aid of the RNG 670) or non-randomly select two cards to be the machine's cards. The non-random selection may, for example, follow a prescribed strategy previously entered into memory by the game designer e.g. the machine may always choose a pair of 7's). The machine cards may or may not be selected from the same deck of 52 cards (that is, if a multiple deck poker game is envisaged, the machine may conceivably choose identical cards to that of the player).

Once the gaming machine is aware of the cards that have been chosen for both the player and the machine, a prize schedule is calculated, based on the probability of either the player and/or the machine winning the hand, in view of the selected cards. In other words, the prize awardable for a winning hand is calculated dependent on the two cards chosen by the player and/or machine. The prize schedule takes into account the relative probability of either the player or the machine winning.

It will be understood that the prize schedule could be predetermined (i.e. the machine contains a look-up table or database which provides pre-calculated prizes for certain selected card combinations), or the prize schedule could be calculated "on the fly" (i.e. the machine contains appropriate rules, routines or formulae used to calculate a prize schedule based on the selected card combinations).

It will be understood that a person skilled in the art would be versed in applying appropriate formulas for calculating the probability of a particular outcome based on the relative probability of each chosen card combination in the poker-style game. For example, it is known that in a poker-style game, the probability of drawing a particular "hand" (i.e. a particular set of cards) can be determined by calculation.

When calculating probabilities for a poker-style card game, there are two basic approaches:

1. Determine the number of outcomes that satisfy the condition being evaluated and divide this by the total number of possible outcomes. For example, there are six outcomes (ignoring order) for being dealt a pair of aces in a Hold'em style poker game. There are 52 ways to pick the first card and 51 ways to pick the second card and two ways to order the two cards yielding 1,326 possible outcomes of being dealt two cards (ignoring order). This gives a probability of being dealt two aces of 6 in 1326, which in turn equates to 1 in 221 (i.e. a player has a one in 221 chance of being dealt two aces).
2. Use conditional probabilities, or in more complex situations, a decision tree. There are 4 ways to be dealt an ace out of 52 choices for the first card resulting in a probability of 4 in 52, which equates to 1 in 13. There are 3 ways of getting dealt an ace out of 51 choices on the second card after being dealt an ace on the first card for a probability of 3 in 51, which equates to 1 in 17. The conditional probability of being dealt two aces is the product of the two probabilities, which is 1 in 121.

The two methods described above, while only calculating the probability of receiving two particular cards, can be readily extended to determine the probability of a player receiving a particular hand. That is, once the two starting cards are known, the probability of either the player or the machine achieving a "winning" hand can be calculated. Such techniques are explained in more detail at a number of publicly available sources, such as the website http://en.wikipedia.org/wiki/Poker_probability, which provides information on how to calculate the "odds" for receiving a particular hand in a poker-style game.

Once the machine calculates the probability of the player securing a "winning" hand (i.e. having a higher outcome than any other player or the machine), the prize schedule is tailored to take into account the relative "risk" associated with the player winning the hand. That is, the probability of a player winning a hand (in view of the player's starting cards and the machine's starting cards) is calculated by the prize schedule determiner 640. Then, knowing the amount bet by the player and the probability that a player will win the hand (expressed as a percentage), a desired "average" return to the player, over a defined number of hands (say, 100 hands) is calculated. Thereafter, the average return is adjusted to take into account any legally mandated return percentages. That is, the prize schedule can be calculated to ensure that the long term return to a player is always at a certain percentage rate, as may be mandated by State or Territorial laws. For example, the operator of the gaming machine may be required, by law, to pay, on average, at least 90% of a player's bets in prizes, over (for example) a cycle of 100 hands of poker.

Therefore, a player that selects cards that result in a higher chance of winning a hand would be given a lower prize schedule, which reflects the fact that they have a higher chance of winning. However, overall, the average return to the player over time remains fixed. Correspondingly, the return to the operator is also fixed.

The embodiment can be used for multiple players. In this instance, the prize schedule for each player is independently determined, according the cards selected by each player. For example, player A with a pair of Aces will have a different prize schedule to player B with a pair of 2's.

Once the prize schedule is calculated, it is displayed to the player, such that the player can make an informed decision on whether to proceed with the hand, or abandon the hand. That is, the player can choose to start a new hand (thereby not risking the entire initial bet amount) or to continue with the hand. If the player chooses to abandon the hand, they may receive a refund of part of their initially wagered amount, depending on the rules of the poker game.

If the player continues with the hand, the remaining cards are dealt in an appropriate random fashion, and the hand is played through to conclusion. That is, each player uses their chosen cards in combination with the dealt cards to determine an outcome. The outcomes are compared by the game control module 630 and the player or machine with the highest outcome is determined as the winner. If the player wins the hand, the player is awarded a prize according to the prize schedule. Of course, in a situation where there are multiple players, the player with the highest overall outcome wins the hand and therefore the prize. Moreover, in games where there is a "high-low format", the game can be extended to cater for payouts to the player with the lowest combination.

The embodiment is equally suited to any standard form of poker, such as but not limited to, Texas Hold'em, Draw Poker, 7 card stud poker and Omaha. Details of different types of poker games may be found at http://en.wikipedia.org/wiki/Poker.

It will be understood that the game may be carried out in multiple stages, with the prize schedule being varied as each additional card (or sub-set of cards) is revealed. Moreover, many game formats, including Texas Hold'em and 7 card stud have multiple stages of the draw of cards at which side bets may also be wagered. These bets may be placed on various hands and for various results including win, draw or loss. Such side bets may be incorporated with or without varying the prize schedule, as may be desired by the game operator.

Embodiments of the invention are illustrated through the three simplified examples, given below.

Example 1

Texas Hold'em Against Weak Computer

This example is for a Texas Hold'em against a solitary computer hand. In the embodiment below, only the player's cards are selected by the player (i.e. the machine's cards are automatically determined). The hands are as follows:

Machine's cards: Two "2" cards (i.e. each card has a face value of "2")

Player's cards: Two Aces

The probability of the player winning the hand is shown in Table 1:

TABLE 1

| Probability of player winning hand. | |
|---|---|
| Win | 81.3% |
| Draw | 00.5% |
| Loss | 18.2% |

Therefore, the prize schedule may be set so that there is provided a payout of $11.01 for a win and $10.00 for a draw. This assumes an expected return to the player of 90.01% over time (assuming the player continue to play for a statistically significant time).

Example 2

Texas Hold'em Against Strong Computer

The following example is also applied to a Texas Hold'em game where a player plays against a solitary computer hand. The hands are the same as in Example 1, but are reversed as follows:

Machine's Card: Two Aces

Player's cards: Two "2" cards (i.e. each card has a face value of "2")

In this case, the probabilities are reversed, such that the chance of the player winning the hand is:

TABLE 2

| Probability of player winning hand | |
|---|---|
| Win | 18.2% |
| Draw | 00.5% |
| Loss | 81.3% |

Therefore, a payout of $49.18 for a win and $10.00 for a draw results, assuming an average expected return to the player of 90.01%.

Example 3

Texas Hold'em on a Multiplayer Table

The table is configured to play four standard hands requiring up to four players. This game can still operate even if some players are missing. If the selected hands are:

| | |
|---|---|
| Player 1: | An Ace of Hearts and a King of Diamonds |
| Player 2: | A Jack and a Queen of Spades |
| Player 3: | A pair of "9"s (Diamonds and Spades) |
| Player 4: | A "4" of Clubs and a 5 of Clubs |

In this game the chance of Player 1 winning the hand is shown in Table 3 below.

TABLE 3

| The probability of player 1 winning the hand. | |
|---|---|
| Win | 28.2% |
| Draw | 0.2% |
| Loss | 71.6% |

Then appropriate payouts for a 90% return rate to player 1 are $31.84 for a win and $10.00 for a draw.

As can be seen, the embodiment and the broader invention described herein provide a high level of interaction between the player and the gaming machine, requiring the player to make a number of choices. In turn, this fosters a sense of involvement in the game, which is traditionally lost with conventional "video" poker games. Simultaneously, the machine operator, through use of an appropriate prize schedule, can ensure that the average return to the player remains fixed, thereby complying with relevant State and/or Territorial laws.

Players, over time, will learn that choosing low risk (strong) card pair choices result in low potential prizes, and high risk (weak) card pair choices may result in high prizes being awarded. As such, the player can moderate their level of "risk" and thereby exercise more control over the game. This also serves to capture some of the excitement of a traditional poker game.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. It will be understood that the invention disclosed and defined in this specification extends to all alternative combinations of two or more of the individual features mentioned or evident from the text or drawings. All of these different combinations constitute various alternative aspects of the invention.

The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CDROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The invention claimed is:

1. A gaming method for providing a poker-style game on a gaming device, comprising:

selecting at least one player card to form at least part of a player hand, selecting at least one machine card to form at least part of a machine hand, calculating a probability of the player hand being a winning hand in comparison to the machine hand, calculating a prize schedule payable to the player if the player were to win a completed hand based on the selected cards, the prize schedule to be calculated at least in part based on the calculated probability of the playing securing a winning hand and a predefined proportion of turnover of the gaming device, and providing the prize schedule to the player, wherein the player decides whether to continue with the hand based on the calculated prize schedule.

2. A method as claimed in claim 1, wherein the player selects the at least one player card.

3. A method as claimed in claim 1, wherein the player selects the at least one machine card.

4. A method as claimed in claim 1, wherein the player selects two player cards.

5. A method as claimed in claim 1, wherein the player selects two machine cards.

6. A method as claimed in claim 1, wherein at least one of the player cards and machine cards are selected from a standard deck of 52 playing cards.

7. A method as claimed in claim 1, wherein at least one of the player cards and machine cards are chosen from a sub-set of standard playing cards, the sub-set being pre-selected by the gaming device.

8. A method as claimed in claim 1, comprising, for each of a plurality of players, selecting at least one player card, and calculating a prize schedule payable to each of the plurality of players.

9. A method as claimed in claim 1, wherein, if the player selects to continue with the hand, further cards are dealt in a randomised manner, until the hand is completed.

10. A method in accordance with claim 9, wherein, on each further card being dealt, re-calculating the prize schedule, and allowing the player to decide whether to continue with the hand based on the re-calculated prize schedule.

11. A gaming device operable to carry out play of a poker-style game, the gaming device comprising;

a game control module arranged to select at least one player card and at least one machine card from at least one deck of cards, a prize schedule determination module arranged to calculate a probability of the player hand being a winning hand in comparison to the machine hand and to calculate a prize schedule payable to the player if the player were to win a completed hand based on the current card selection, the prize schedule to be calculated at least in part based on the calculated probability of the playing securing a winning hand and a predefined proportion of turnover of the gaming device, a display module arranged to provide the prize schedule to the player, and an interface arranged to allow the player to determine whether to continue with the hand based on the calculated prize schedule.

12. A gaming device as claimed in claim 11, the interface is further operable to allow the player to instruct selection of either or both the player card and machine card.

13. A gaming device as claimed in claim 12, wherein the game control module allows the player to select two player and/or machine cards.

14. A gaming device as claimed in claim 11, wherein at least one of the player cards and machine cards are selected from a standard deck of 52 playing cards.

15. A gaming device as claimed in claim 11, wherein at least one of the player cards and machine cards are chosen from a sub-set of standard playing cards pre-selected by the gaming device.

16. A gaming device as claimed in claim 11, wherein, where a plurality of players are participating in the poker-style game, the device is arranged to select at least one player card for each player and display a prize schedule payable to each of the plurality of players based on their respective hands.

17. A gaming device as claimed in claim 11, wherein, if the player selects to continue with the hand, further cards are dealt by the game control module in a randomised manner, until the hand is completed.

18. A gaming device in accordance with claim 17, wherein, on each further card being dealt, the prize calculation module re-calculates the prize schedule and displays it to the player(s), the players allowed to determine whether to continue with the hand based on the re-calculated prize schedule.

19. A gaming system comprising:

a plurality of gaming devices which may participate in a poker-style game; and a game control module arranged to allow the selection of at least one player card and at least one machine card from at least one deck of cards, a prize schedule determination module arranged to calculate a probability of the player hand being a winning hand in comparison to the machine hand and to calculate a prize schedule payable to the player if the player were to win a completed hand based on the current card selection, the prize schedule to be calculated at least in part based on the calculated probability of the playing securing a winning hand and a predefined proportion of turnover of the gaming device, a display module arranged to display the prize schedule to the player, and an interface arranged to allow the player to decide whether to continue with the hand based on the calculated prize schedule.

20. A computer readable medium including computer program code which when executed implements a gaming method for providing a poker-style game on a gaming device, comprising:

selecting at least one player card to form at least part of a player hand, selecting at least one machine card to form at least part of a machine hand, calculating a probability of the player hand being a winning hand in comparison to the machine hand, calculating a prize schedule payable to the player if the player were to win a completed hand based on the selected cards, the prize schedule to be calculated at least in part based on the calculated probability of the playing securing a winning hand and a predefined proportion of turnover of the gaming device, and providing the prize schedule to the player, wherein the player decides whether to continue with the hand based on the calculated prize schedule.

* * * * *